US007347008B2

(12) United States Patent
Zupancic et al.

(10) Patent No.: US 7,347,008 B2
(45) Date of Patent: Mar. 25, 2008

(54) SYSTEM AND METHOD FOR CONTROLLING THE OPERATING PARAMETERS OF A SETTING SYSTEM

(75) Inventors: Joel K. Zupancic, Joliet, IL (US); Tomasz P. Kocjan, Northbrook, IL (US)

(73) Assignee: M&R Printing Equipment, Inc., Glen Ellyn, IL (US)

( * ) Notice: Subject to any disclaimer, the term of this patent is extended or adjusted under 35 U.S.C. 154(b) by 0 days.

(21) Appl. No.: 10/603,018

(22) Filed: Jun. 24, 2003

(65) Prior Publication Data

US 2004/0261287 A1 Dec. 30, 2004

(51) Int. Cl.
*F26B 3/00* (2006.01)

(52) U.S. Cl. ..... 34/497; 34/562

(58) Field of Classification Search ..... 34/266, 34/268, 562, 497; 347/180, 41; 101/123, 101/129; 318/432; 8/471; 68/5 D
See application file for complete search history.

(56) References Cited

U.S. PATENT DOCUMENTS 4,385,452 A * 5/1983 Deschaaf et al. ..... 34/562
4,698,767 A * 10/1987 Wensel et al. ..... 700/127
5,117,562 A * 6/1992 Dulay et al. ..... 34/550
5,218,908 A * 6/1993 Whitfield ..... 101/487
5,239,613 A * 8/1993 Motev et al. ..... 392/412
5,489,981 A * 2/1996 Killpatrick et al. ..... 356/459
5,813,134 A * 9/1998 Min et al. ..... 34/255
5,828,178 A * 10/1998 York et al. ..... 315/151
5,852,881 A * 12/1998 Kuroda et al. ..... 34/527
5,908,000 A * 6/1999 Spychalla et al. ..... 101/487
6,026,588 A * 2/2000 Clark et al. ..... 34/77
6,340,225 B1 * 1/2002 Szlucha ..... 347/102
6,388,690 B1 * 5/2002 Kurachi ..... 347/180
6,456,826 B1 * 9/2002 Toskala et al. ..... 455/63.1
6,751,888 B2 * 6/2004 Lueckenbach ..... 34/595

OTHER PUBLICATIONS

Rhodefer, Brian E. "Re: Need AC zero cross detection circuit". [online]. Newsgroups: sci.electronics.design; Aug. 25, 1997 [Retrieved on Apr. 23, 2003] Retrieved from Internet <URL:http://groups.google.com/groups?q=triac+carry&start=20&hl=en&Ir=&ie=UTF-8&oe=UTF-...>.

* cited by examiner

*Primary Examiner*—S. Gravini
(74) *Attorney, Agent, or Firm*—Schwartz Cooper Chartered

(57) ABSTRACT

A system includes a device for setting a material, such as ink, deposited on a textile or graphic. A programmable logic controller includes a power intensity selector and an application module and is operably connected to the device. The application module is capable of generating a power intensity output signal in response to the power intensity selector. The power intensity output signal is transmitted to the device for a predetermined time period.

17 Claims, 3 Drawing Sheets

Calculation Interval

Base Resolution = 100

SYSTEM AND METHOD FOR CONTROLLING THE OPERATING PARAMETERS OF A SETTING SYSTEM

TECHNICAL FIELD

The present invention generally relates to the printing machines. More specifically, the present invention involves a system and method for improving control of the operating parameters of a device utilized in setting a material printed on textiles and graphics.

BACKGROUND OF THE INVENTION

Printed indicia for applying to items of clothing, such as T-shirts, sweatshirts, golf shirts, shorts, hats, and the like, as well as other cloth and paper goods, such as banners, posters, bags, flags, and the like, have become very popular over the last 30 years. Boutiques specializing in printing fanciful and textual indicia such as slogans, college names, sports team names and logos, licensed characters, and the like, on these various media, are commonly seen in stores across the country. The indicia available at these stores can be pre-printed on a substrate and applied with a heated press by operators at such boutiques to any of the aforementioned items purchased by a consumer, or they can be screen printed directly onto the items for later purchase.

In the screen printing process, a stencil screen is typically blocked (called "masked" in the industry) to embody the desired indicia and then placed over the item to be printed. A material, e.g., ink, of one color is then added to the screen surface and flooded onto the indicia by a flood bar of conventional design. The ink may be of any type well-known in the industry for screen printing. After the ink is flooded onto the screen, the ink is squeegeed through the screen interstices onto the item, leaving ink of the desired color where the interstices in the screen are unblocked. The squeegee can be of any type known in the art. Each color is applied separately through screen printing. At times during the printing process the article is also cured or dried through conventional and well known means to set the ink and prevent smearing etc. After printing is completed on the item, the item printed upon is typically moved to a dryer or the like to permanently set the ink onto the substrate or textile.

Assignee of the present invention, M&R Printing Equipment, Inc., Glen Ellyn, Ill., makes several successful textile and graphics printing presses, such as the PROCESSOR®, the RENEGADE™, the PATRIOT®, the ECLIPSE™, the SATURN™, the ADVANTAGE™, the CONQUEST™, the CHALLENGER®, the GAUNTLET®, the SPORTSMAN™, the TERMINATOR™, the ULTIMATE®, the PREDATOR®, the CHAMELEON®, the PREMIERE™, the TRANSFER PRESS™, the BELTPRINTER™, and the PERFORMER™, screen printing systems.

As to particulars, a screen printing machine has at least one station for each color employed. For example, a design incorporating two colors will have at least two printing stations, one for each color. A design employing eight colors will have at least eight stations. Each station generally includes a printing head, which supports a single screen, the specific ink to be used at that station, and a mechanism for applying the ink to the textile. Only one color is employed at each station. The machine will frequently employ one or more setting devices, e.g., flash curing unit, heater, dryer, etc., to cure or set the ink. Specifically, a curing unit is frequently disposed between each printing head so that the textile being printed upon is cured immediately upon printing and before the next color is printed on the first color. For this reason, curing units are made to replace printing heads at the stations. Thus, a machine having 8 stations may have 4 printing head stations and 4 curing stations, with each curing station being disposed between printing stations.

Generally, the substrate to be printed upon travels from station (printing or curing) to station (printing or curing) by one of a number of methods, such as a chain (oval machine) or a rigid arm (carousel/turret machine). In some less expensive models, printing heads are brought to the textile being printed upon.

There are generally three types of machines, that being in-line, rotary—often called a carousel or turret—and oval. In a carousel machine, the stations (with either a printing head or a flash curing unit) are supported on spoking spider arms. The textiles to be printed upon are supported on pallets. These pallets are supported by a separate set of spoking spider arms usually situated below the spider arms supporting the printing heads or curing units. The spider arms carrying the pallets rotate and stop under each station. After stopping, the pallets are brought proximate the printing head or curing unit and printed upon or flash cured. Thereafter, the spider arms supporting the pallets are rotated to the next station.

In an in-line or oval machine, a chain drives the pallet supporting the textile or graphics from station to station. At each station, a printing head or curing unit engages the textile or graphics and prints or cures the material upon the textile or graphics.

In each of the above machines, space or areas are provided (between the spider arms of the turret machine or along a part of the oval track of the oval machine) to load and unload the textiles or graphics onto or from the pallets.

Numerous inks are available in the industry from many different producers. Such inks include water base, sublimation, and plastisol. The ink is cured or gelled on the textile, graphic, or substrate to a critical temperature. The temperature during the curing process must be kept within a window suitable for the ink-setting conditions, typically between 125° F. to 450° F. Unfortunately, with some inks and/or textiles, temperatures are crucial. The quality, color and lifetime of a product may be negatively affected by incorrect temperatures and curing or flash times. For example, with plastisols, the temperature must reach 320° F. However, in a range (below 320° F. or above 350° F.), the plastisol will not properly set, resulting in cracking, or it may become liquified. For example, if the temperature is too low, the plastisol will not cure properly, and will not adhere to the textile/substrate; if the temperature exceeds 350° F., the plastisol will over-gel. Similarly, if a dye in the textile is overheated, it will migrate. Dye sublimation occurs if a textile printed upon is over heated, or "over flashed," resulting in the dyes of the textile sublimating into the ink. Finally, the textile or substrate being printed upon may scorch or burn, thereby ruining the product and increasing waste and production costs.

In addition to the above, the color set onto the textile will be greatly affected by both the temperatures and the flash or curing time. Clearly, the curing process and machinery are integral to ensure the quality of printed pattern. As such, there are various operating parameters that must be monitored and controlled.

Today's printing processes utilize multiple devices and sensors to facilitate the printing and screening steps and to ensure high quality results. Detailed planning is required to coordinate and integrate the various devices into a reliable manufacturing process.

Several important steps, e.g., sub-processes, in the overall printing process are, or should be, monitored to ensure high quality printing on textiles and graphics. One such integral sub-process involves the aforementioned setting of the deposited ink. It is important to closely monitor the operating parameter, e.g., temperature, power intensity, etc., associated with the apparatus used for setting the ink to ensure proper curing of the printed material. Essential to the curing process is the amount of power supplied to the elements of the setting apparatus or unit. Curing equipment commonly used lacks the precision required to effectively adapt the setting parameters and the device's elements, e.g., quartz bulbs, to the full range of temperatures necessary for proper curing.

Thus, a need exists in the screen printing industry for a control process having the capability to provide precise levels of power to the setting device used during curing of the printed material. In addition, centrally controlling the various sub-processes will significantly improve the quality of the overall printing process.

The present invention is provided to solve these and other problems and to improve upon existing presses and processes.

SUMMARY OF THE INVENTION

The present invention is directed to a system and method for improving the setting process of a printed material on a textile. More specifically, a programmable logic controller is utilized to control a setting system. The setting system includes a device, e.g., heater, flash unit, dryer, etc., for setting the printed material placed on a textile or graphic. The programmable logic controller is operably connected to the device and comprises a power intensity selector. An application module operably connected to the programmable logic controller is capable of generating a power intensity output signal. The power intensity output signal is responsive to the power intensity selector. A time selector provides a time cycle duration for applying the power intensity output signal to the device.

A further aspect of the present invention includes the application module further comprising a calculation interval and a base resolution amount. The power intensity output signal is determined by the base resolution amount in cooperation with the power intensity selector. The determination of the power intensity output signal is initiated in response to receiving a calculation interval signal.

These and other aspects and attributes of the present invention will be discussed with reference to the following drawings and accompanying specification.

BRIEF DESCRIPTION OF THE DRAWINGS

In the accompanying drawings forming part of the specification, and in which like numerals are employed to designate like parts throughout the same.

DETAILED DESCRIPTION

Figure 1:
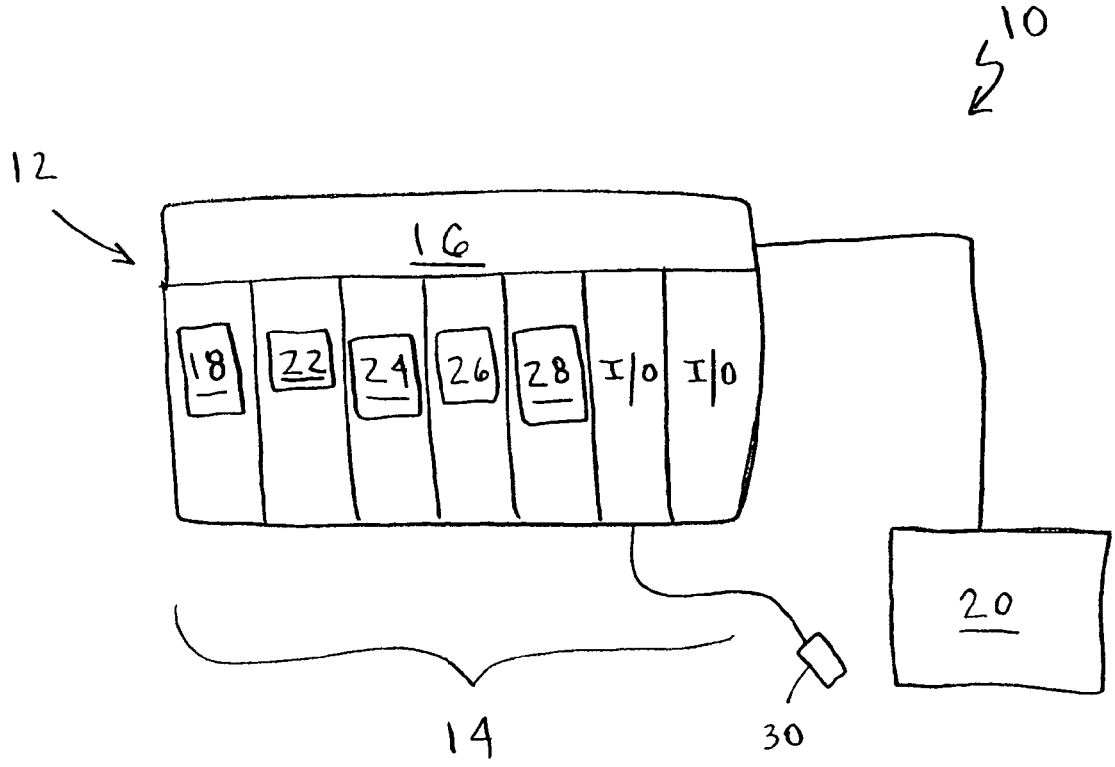
FIG. 1 is a block diagram of one embodiment of the present invention.

While this invention is susceptible to embodiments in many different forms, there are shown in the drawings and will herein be described in detail, preferred embodiments of the invention with the understanding that the present disclosures are to be considered as exemplifications of the principles of the invention and are not intended to limit the broad aspects of the invention to the embodiments illustrated.

The present invention is directed to improving the screen printing process on a printed textile or graphics. More specifically, the present invention incorporates a programmable logic controller to monitor and control various operational parameters utilized in a setting, e.g., curring process of a material printed on a textile or graphic.

Referring to FIG. 1, a setting system 10 includes a programmable logic controller (PLC) 12. A plurality of modules 14 reside within the programmable logic controller 12 and are operably connected to each other via a backplane 16. Various types of modules 14 can be used and are capable of being connected to input devices, output devices, and input/output devices. One of the modules 14 contains an application module 18. The application module 18 can be hardware, software, or a combination thereof wherein various information about the manufacturing process is monitored and utilized to more effectively control the manufacturing process and produce a quality product at less cost.

A critical operational parameter to monitor and control during the manufacturing process, and more particularly the setting process, is the amount of power supplied to a setting device 20, e.g., heater, flash curing unit, dryer, etc., employed to set, e.g., cure, the ink deposited on the textile or graphics material. The device 20 is operably connected to one of the modules 14 of the programmable logic controller 12. A power intensity selector 22 enables a user to select a desired amount of power intensity to supply to the device 20. Preferably, a range of percentages of the power intensity is selectable from the power intensity selector 22.

The programmable logic controller 12 also includes a time cycle selector 24. The time cycle selector 24 provides a predetermined range of time cycles wherein a generated power intensity output signal is provided to the device 20 for the duration of the time cycle. Once the duration of the selected time cycle expires, the power intensity output signal is no longer provided to the device 20.

Figure 2:
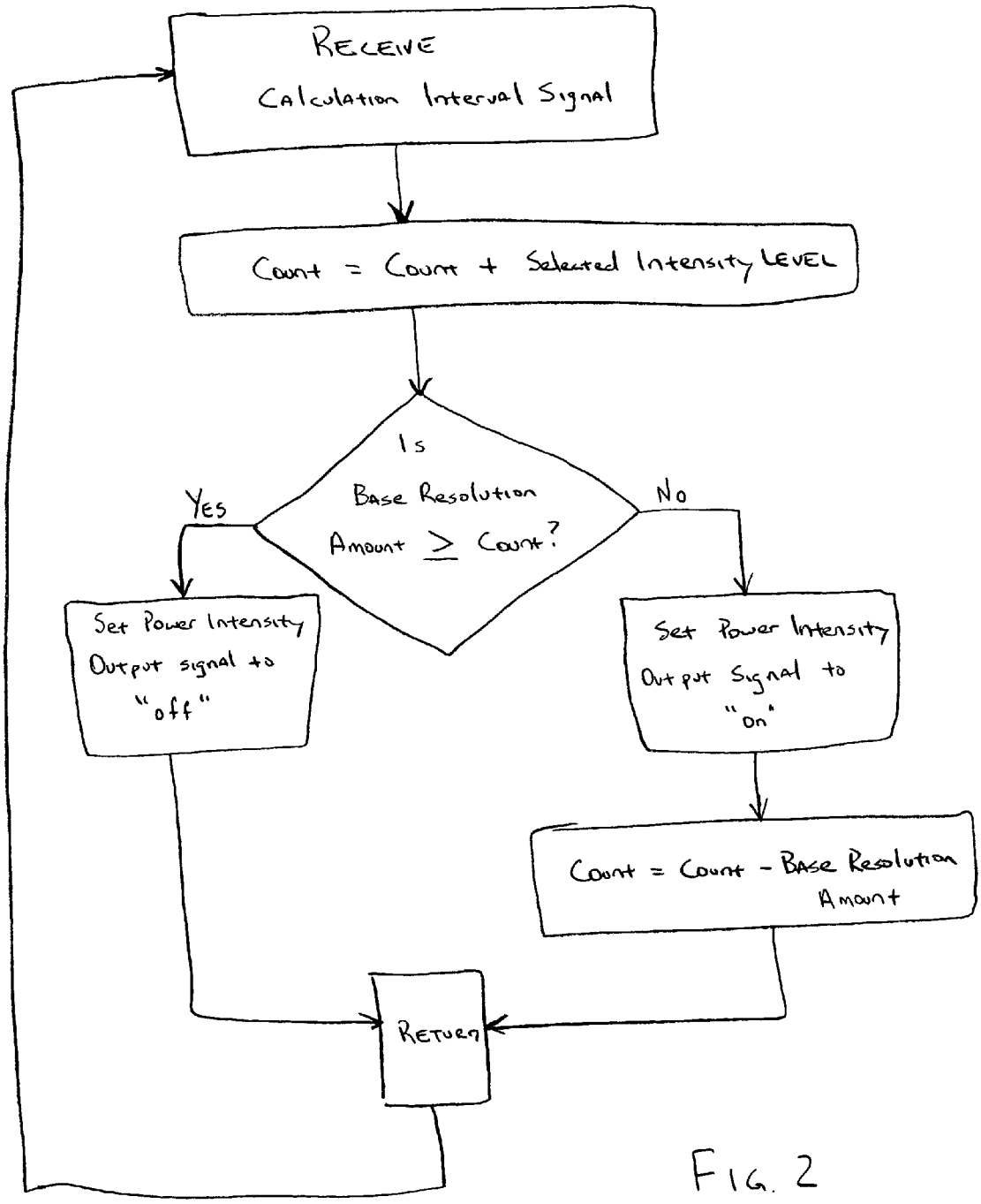
FIG. 2 is a flow chart of one embodiment of the application module of the present invention; and, FIG. 3 is a graph of various power intensity output level signals versus time cycles of the preferred embodiment of the present invention.

The application module 18 utilizes a base resolution amount in cooperation with the selected power intensity level to generate the power intensity output signal. A calculation interval signal initiates the determination of the power intensity output signal. The generated power intensity output signal includes an "ON" state and an "OFF" state. The flow chart shown in FIG. 2 is one example of a procedure executed in cooperation with the application module 18 capable of accurately providing the power intensity output signal of the present invention. The application module 18 utilizes several inputs to generate the power intensity output signal.

For example, the calculation interval signal is received and the determination of the power intensity output signal is initiated. At every trigger of the calculation interval signal, a counter—initially set at zero—is incremented by the amount set at the power intensity selector 22. The counter is compared to a base resolution. When the counter is less than or equal to the base resolution, the power intensity output signal is in the "OFF" state. When the counter is greater than the base resolution, the power intensity output signal is in the "ON" state and the base resolution is subtracted from the counter. In this manner, the power intensity output signal transmitted to the device 20 is proportional to the selected power intensity level—causing the device 20 to operate proportionally to the selected power intensity level.

Figure 3:
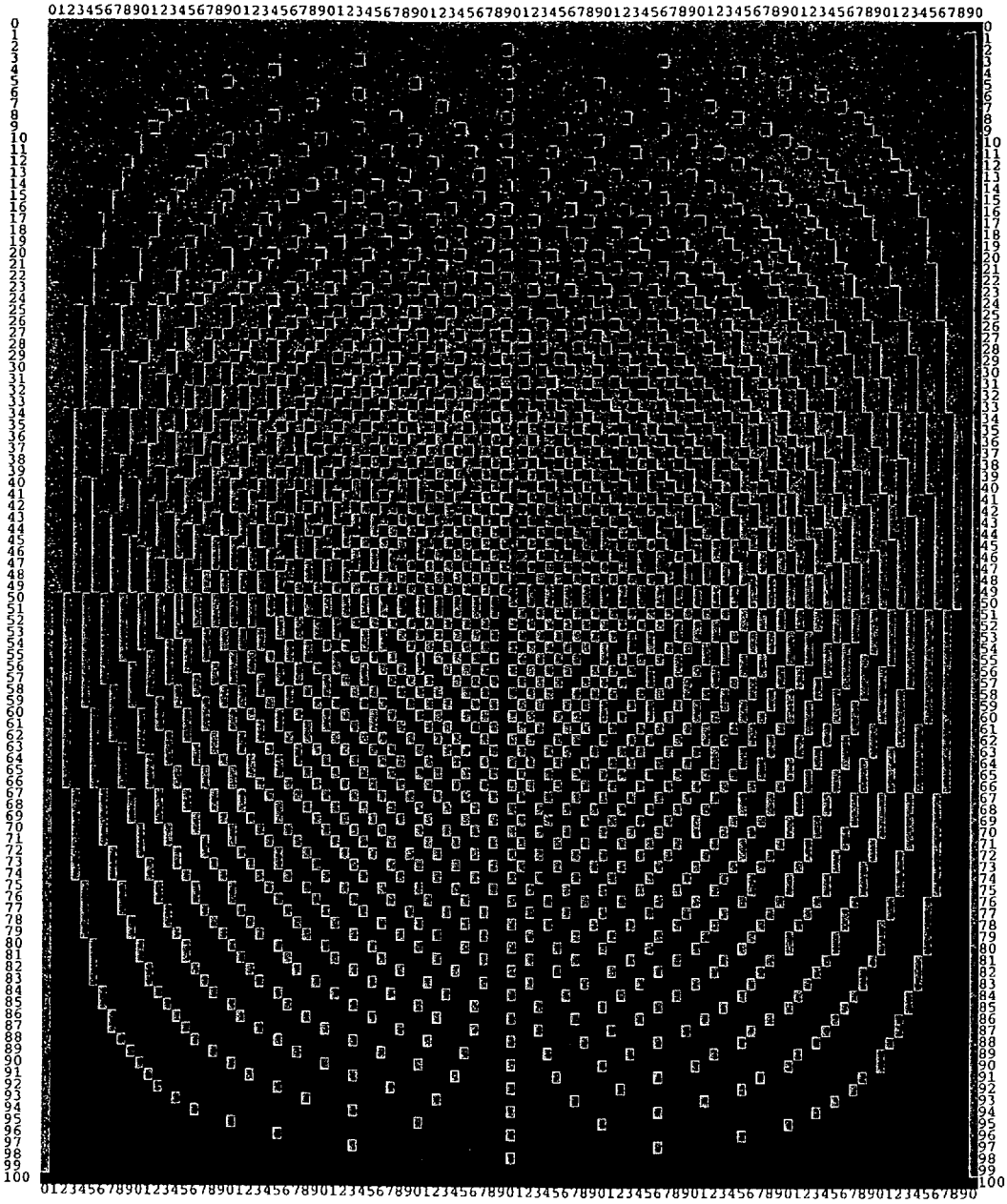

The range of selectable power intensity is from 0-100%. Utilizing a base resolution of 100 yields 100 distinct power intensity output signals over 100 calculation intervals. FIG. 3 illustrates the resulting power intensity output signal over a period of 100 calculation intervals for a selected power intensity level. The rows represent the power intensity output signal generated in response to the selected power intensity and base resolution; and the columns represent a range of 100 calculation intervals wherein the shaded segments represent the "ON" state and the non-shaded segments represent the "OFF" state.

Preferably, the calculation interval signal has a frequency near that of an AC power signal being supplied to the programmable logic controller 12, e.g., 50 Hz or 60 Hz. Utilizing a similar frequency for the calculation interval allows for the switching of the power intensity output signal to be executed near the zero crossing of the AC power signal. Such synchronization greatly reduces the associated electromagnetic interference and stress applied to the setting elements, e.g., quartz bulbs (tungsten), infrared radiant panels, blowers, etc., of the device 20.

The setting elements, e.g., lamps, may be configured in a multiple of banks. A lamp selector 26 provides the user with the ability to select various combinations of lamps to be utilized during the heating of the printed material (ink) on the textile. For example, three banks of lamps may be configured and the user can choose between any combination of the three banks, e.g., a single bank, a pair of any two banks, or all three banks.

A further aspect of the present invention includes monitoring the temperature associated with device 20 and directed to the printed material. An operating temperature threshold level selector 28 can be operably connected to an input module 14 of the programmable logic controller 12. The operating temperature threshold level selector 28 allows the user to set a maximum temperature not to be exceeded by the device 20. A temperature sensor 30 is operably connected to the programmable logic controller 12 wherein the operating temperature emitted by the device 20 is monitored. If the temperature associated the device 20 exceeds the threshold level selected by the user, an interrupt signal will be generated and sent to the application module 18 wherein the power intensity signal output transmitted to the device 20 will be terminated.

It will be understood that the invention may be embodied in other specific forms without departing from the spirit or central characteristics thereof. The present embodiment, therefore, is to be considered in all respects as illustrative and not restrictive, and the invention is not to be limited to the details given herein.

What is claimed is:

1. A method for controlling a device for the drying and heat setting of a material placed on a textile as it is processed by a printing machine, comprising the steps of:

connecting a plurality of control modules operably together through a backplane;

programming an application module for controlling the heat generated by the device;

receiving a power intensity value from a power intensity selector module;

initiating a counter stored in a memory of a time selector module;

incrementing the counter by the power intensity;

comparing the counter and a base resolution; and, transmitting a power intensity output signal to the device based on the counter and the base resolution wherein the power intensity value controls the heat for drying a material on a textile.

2. The method of claim 1, wherein the steps of the method are repeated continuously until the expiration of a predetermined period of time.

3. The method of claim 1, further comprising the step of: selecting the power intensity value via the power intensity selector.

4. The method of claim 1, further comprising the steps of: determining a feature of the device; and, generating a shutdown signal based on a determination that the feature has exceeded a predetermined threshold value.

5. The method of claim 1, further comprising the step of: re-initiating the counter after generating the power intensity output signal.

6. The method of claim 1, further comprising the step of: selecting at least one of a plurality of lamps to receive the power intensity output signal.

7. A system comprising: controlling a device for heat setting a material placed on a textile printing machine, the device operably connected to a programmable logic controller comprising:

a power intensity value selectable on a power intensity module;

an application module for:

initiating a counter;

incrementing the counter by the power intensity value;

comparing the counter and a base resolution; and, generating a power intensity output signal based on the comparison of the counter and the base resolution to control the heat setting generated by the device.

8. The system of claim 7, wherein a shutdown signal is generated for the system upon the expiration of a predetermined period of time.

9. The system of claim 8, further comprising a time cycle selector for determining the predetermined period of time.

10. The system of claim 7, further comprising a power intensity selector for determining the power intensity value.

11. The system of claim 7, further comprising a sensor for determining a feature of the system.

12. The system of claim 11, further comprising an actuator for generating a shutdown signal upon a determination that the feature has exceeded a predetermined threshold value.

13. The system of claim 7, wherein the application module is also for re-initiating the counter after generating the power intensity output signal.

14. The system of claim 7, wherein the application module is also for transmitting the power intensity output signal to a device for setting the material.

15. The system of claim 7, further comprising a selector for selecting at least one of a plurality of lamps to receive the power intensity output signal.

16. A system comprising: controlling a device for heat setting material placed on a textile as it is processed by a printing machine, the device operably connected to a programmable logic controller comprising:

a power intensity selector on a module for selecting a power intensity value;

a time cycle selector on a module for selecting a duration value;

a temperature selector on a module for selecting a temperature value;

a base resolution selector on a module for selecting a base resolution;

a lamp selector on a module for selecting at least one of a plurality of lamps to receive the power intensity output signal;

an application module configured to initiate a counter; increment the counter by the power intensity value; determine whether the counter is greater than the base resolution; upon a determination the counter is greater than the base resolution, generate a power intensity output signal and decrementing the counter by the base resolution; otherwise, increment the counter by the power intensity value; sense the temperature of an element of the system; determine whether the temperature of the element of the system has exceeded the temperature value; upon a determination the temperature of the element of the system has exceeded the temperature value, generate a system shutdown signal; compare the counter and the duration value; and, based upon the comparison of the counter and the duration value, generate a system shutdown signal; and a backplane operably connecting the modules to each other to provide the communication path between modules to handle input and output signals from each module.

17. A system comprising: controlling a device for heat setting a material placed on a textile as it is processed by a printing machine, the device operably connected to a programmable logic controller comprising:

a backplane operably connecting each module in the programmable logic controller together for generating a power intensity value;

an application module for:

initiating a counter;

incrementing the counter by the power intensity value;

comparing the counter and a base resolution; and, generating a power intensity output signal based on the comparison of the counter and the base resolution, wherein the base resolution is proportional to the power intensity value.

* * * * *